US011724871B2

(12) United States Patent
D'Alfonso et al.

(10) Patent No.: US 11,724,871 B2
(45) Date of Patent: Aug. 15, 2023

(54) RIGID PACKS FOR SMOKING ARTICLES WITH A DOUBLE HINGED LID AND BLANKS TO MANUFACTURE SAID RIGID PACK FOR SMOKING ARTICLES

(71) Applicant: G.D SOCIETA' PER AZIONI, Bologna (IT)

(72) Inventors: Lorena D'Alfonso, Bologna (IT); Roberto Polloni, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 96 days.

(21) Appl. No.: 17/425,528

(22) PCT Filed: Jan. 24, 2020

(86) PCT No.: PCT/IB2020/050575
§ 371 (c)(1),
(2) Date: Jul. 23, 2021

(87) PCT Pub. No.: WO2020/152649
PCT Pub. Date: Jul. 30, 2020

(65) Prior Publication Data

US 2022/0161989 A1 May 26, 2022

(30) Foreign Application Priority Data

Jan. 25, 2019 (IT) ..... 102019000001127

(51) Int. Cl.
*B65D 85/10* (2006.01)
*B65D 5/66* (2006.01)

(52) U.S. Cl.
CPC ..... *B65D 85/1056* (2020.05); *B65D 5/6691* (2013.01); *B65D 85/1048* (2020.05)

(58) Field of Classification Search
CPC ..... B65D 85/1056; B65D 85/1048; B65D 85/1045; B65D 5/6691; B65D 5/66; B65D 85/10; B65D 85/1072; B65D 85/1063
(Continued)

(56) References Cited

U.S. PATENT DOCUMENTS 2,983,424 A * 5/1961 Glass ..... B65D 85/1036 206/256
5,074,412 A * 12/1991 White ..... B65D 85/1045 206/256
(Continued)

FOREIGN PATENT DOCUMENTS

CN 2488869 Y 5/2002
CN 2815948 Y 9/2006
(Continued)

OTHER PUBLICATIONS

International Search Report and Written Opinion, corresponding International Application No. PCT/IB2020/050575, dated Apr. 29, 2020.
(Continued)

*Primary Examiner* — Rafael A Ortiz
(74) *Attorney, Agent, or Firm* — Marshall, Gerstein & Borun LLP

(57) ABSTRACT

A pack for smoking articles can include two groups of smoking articles arranged adjacent to each other; an inner containing element surrounding the two groups, having two distinct and separate extraction openings to access the respective groups of smoking articles, and having a front wall, two side walls and/or a rear wall; an outer containing element arranged around the inner containing element, surrounding the two groups, and having a rear wall; and two lids, which are hinged at opposite ends of the rear wall of the outer containing element, rotate between an open and closed
(Continued)

position of the corresponding extraction openings, and each having a rear wall hinged to the rear wall of the outer containing element, two side walls, one front wall and one end wall.

11 Claims, 9 Drawing Sheets

(58) Field of Classification Search
USPC ..... 206/261, 268, 242, 262, 271, 273, 276; 229/103.2, 101, 120.03, 121, 87.12–87.14
See application file for complete search history.

(56) References Cited

U.S. PATENT DOCUMENTS

| | | | | |
|---|---|---|---|---|
| 5,074,512 | A | 12/1991 | Gianforcaro, II et al. | |
| 5,845,770 | A | 12/1998 | James et al. | |
| 6,296,113 | B1 * | 10/2001 | Bartels | B65D 5/6691 206/268 |
| 2004/0112771 | A1 * | 6/2004 | Bailey | B65D 75/5838 206/271 |
| 2010/0065449 | A1 * | 3/2010 | Morgan | B65D 5/38 206/256 |
| 2017/0113865 | A1 | 4/2017 | Swede et al. | |

FOREIGN PATENT DOCUMENTS

| | | | | | |
|---|---|---|---|---|---|
| CN | 1868826 | A | | 11/2006 | |
| CN | 203889342 | U | | 10/2014 | |
| CN | 204507756 | U | | 7/2015 | |
| CN | 205633344 | U | | 10/2016 | |
| DE | 102016010658 | A1 | | 3/2017 | |
| GB | 2275464 | A | * | 8/1994 | B65D 5/4275 |
| GB | 2534216 | A | * | 7/2016 | A24F 15/12 |
| WO | WO-99/43576 | A1 | | 9/1999 | |
| WO | WO-2008104870 | A1 | | 9/2008 | |
| WO | WO-2012176220 | A1 | * | 12/2012 | B65D 85/1045 |
| WO | WO-2016001123 | A1 | * | 1/2016 | B65D 85/1045 |

OTHER PUBLICATIONS

Written Opinion of the International Preliminary Examining Authority, corresponding International Application No. PCT/IB2020/050575, dated Dec. 23, 2020.
International Preliminary Report on Patentability, corresponding International Application No. PCT/IB2020/050575, dated Apr. 20, 2021.
Article 34 Amendments and Response to the International Search Report and Written Opinion dated Nov. 16, 2020.
Response to Second Written opinion of the International Preliminary Examination Authority, dated Feb. 9, 2021.

* cited by examiner

RIGID PACKS FOR SMOKING ARTICLES WITH A DOUBLE HINGED LID AND BLANKS TO MANUFACTURE SAID RIGID PACK FOR SMOKING ARTICLES

CROSS-REFERENCE TO RELATED APPLICATIONS

This patent application is a U.S. national phase of International Patent Application No. PCT/IB2020/050575 filed Jan. 24, 2020, which claims the benefit of priority from Italian patent application No. 102019000001127 filed on Jan. 25, 2019, the respective disclosures of which are each incorporated herein by reference in their entireties.

TECHNICAL FIELD

The present invention relates to a rigid pack for smoking articles with a hinged double lid and a blank for producing said rigid pack for smoking articles.

The present invention finds advantageous application in a cigarette pack, which the description below will make explicit reference to without any loss of generality thereby. In the present text, in fact, reference will be made indiscriminately to the specific example of "cigarettes", rather than to the more generic expression "smoking articles", without however any loss of generality thereby in relation to other types of articles (such as cigars, cigarillos, electronic cigarettes or e-cigs, auxiliary products such as filters, refills for e-cigs, and other tobacco products or alternative components or tobacco substitutes).

PRIOR ART

Rigid cigarette packs with a hinged lid are the most popular cigarette packs currently on the market because they are easy to make, easy and practical to use, and offer good protection to the cigarettes inside them. A rigid pack of cigarettes with a hinged lid comprises an inner wrapping consisting of a group of cigarettes wrapped in a sheet of metallic paper and a rigid outer casing housing the inner wrapping. The inner wrapping is initially completely closed and has an extraction opening for the cigarettes that can be closed by a disposable, tear-away portion (called a "pull") that is removed when the cigarette pack is opened for the first time to allow the enclosed cigarettes to be extracted from the inner wrapping. Otherwise, it can be closed by a reusable closure label (i.e. "open & close" type) that is connected to the inner wrapping by means of a repositionable glue. In known rigid packs, the outer casing consists of a cup-shaped container with an open top end and a lid, which is also cup-shaped and hinged to the container to rotate between an open and a closed end position in relation to the container itself. A sheet of transparent plastic overwrapping (normally cellophane or polypropylene) is wrapped around the outer wrapping, the sheet being heat-sealed to preserve the moisture and aroma of the tobacco. Double rigid cigarette packs, i.e. two cigarette packs beside one another, or overlapping, are also known. Double cigarette packs usually comprise a cup body comprising a front wall, a rear wall, and two side walls that define a housing space that is divided in two by a dividing element. In this case, each housing space has its own lid hinged to the cup body. Typically, the group of cigarettes (which may or may not be surrounded by an inner wrapping) is collected in one compartment, while, in the other compartment, used cigarettes or accessories, such as a lighter or another group of cigarettes (which may or may not be surrounded by an inner wrapping), are collected. In this case, the group of cigarettes collected inside the other compartment may comprise cigarettes of a different type (e.g. flavoured cigarettes) from the group of cigarettes collected in the other compartment.

The tobacco product directives currently in force require that at least 26% of the outer front and rear wall of cigarette packs must be covered by pictures and writings with health warnings about the dangers of smoking. Furthermore, the directive prohibits promotional and misleading elements being applied to the outer wrapping of tobacco products.

Therefore, the packs of a known type have the disadvantage of having a reduced surface area available for the application of promotional messages and/or images. In fact, in current packages it is only possible to apply promotional messages and/or images on the surface of the collar projecting from the cup body and visible when the lid is opened.

DESCRIPTION OF THE INVENTION

The purpose of the present invention is, therefore, to provide a rigid pack for smoking articles with a hinged double lid and a blank for producing said rigid pack for smoking articles that are free of the drawbacks of the prior art, and that are easy and economical to produce.

According to the present invention, a rigid pack for smoking articles with a hinged double lid is provided as well as a blank for producing said rigid pack for smoking articles as claimed in the attached claims.

BRIEF DESCRIPTION OF THE DRAWINGS

The present invention will now be described with reference to the accompanying drawings, illustrating some non-limiting embodiments thereof, wherein.

PREFERRED EMBODIMENTS OF THE INVENTION

Figure 1:
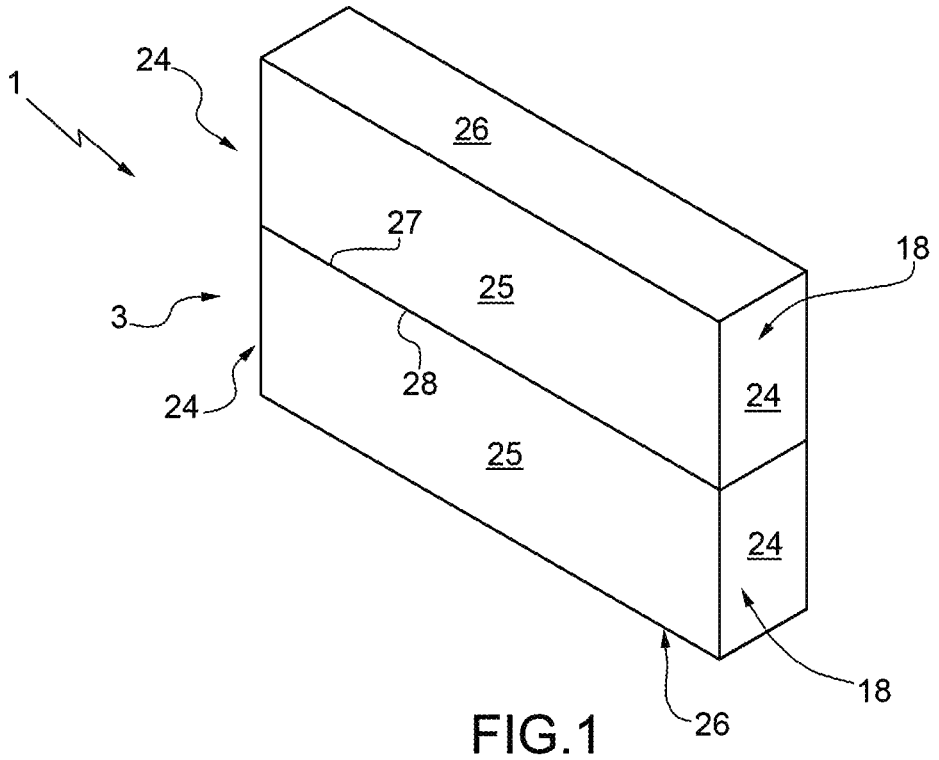
FIG. 1 is a front perspective view of a cigarette pack according to a first embodiment with both lids in the closed position and produced in accordance with the present invention.

In FIG. 1, the reference numeral 1 globally denotes a cigarette pack. The cigarettes housed in the pack 1 can be, for example, HNB cigarettes (acronym for heat-not-burn, i.e. cigarettes wherein the tobacco is heated and not burned) or cigarettes of a reduced height. The cigarette pack 1 has a substantially rectangular parallelepiped shape.

The term "width" means a dimension measured parallel to the rear wall and perpendicular to the side walls.

The term "height" means a dimension measured parallel to the rear wall and perpendicularly to the end walls (closed pack).

The cigarette pack 1 comprises an inner containing element 2 (visible in FIGS. 3-6) and an outer containing element 3 (visible in FIGS. 1-6) preferably made of ordinary or rigid cardboard.

Figure 7:
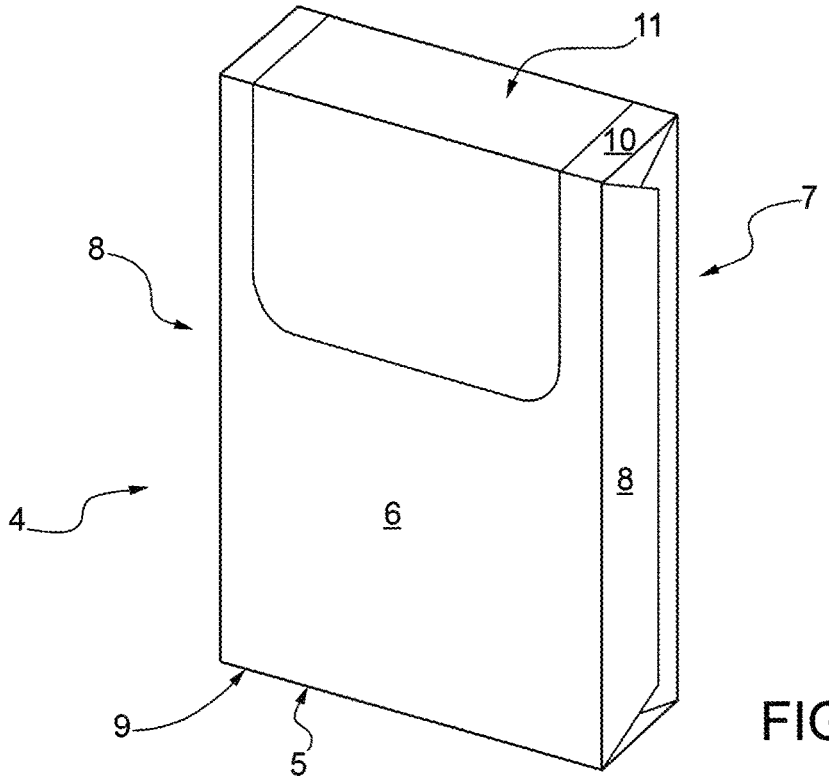
FIG. 7 is a perspective view of a group of cigarettes enclosed in an inner wrapping.

Two groups 4 of cigarettes are arranged in the inner containing element 2. Each group 4 of cigarettes is preferably surrounded by a respective inner wrapping 5 (as shown in FIG. 7).

The groups 4 of cigarettes have, respectively: one front wall 6, one rear wall 7, two side walls 8, one lower wall 9, and one upper wall 10. At the front wall 6 and the top wall 10 of the group 4 of cigarettes, there is an opening 11 for extracting the cigarettes. The two groups 4 of cigarettes are arranged one adjacent to the other. In particular, the two groups 4 of cigarettes are arranged so that they are rotated by 180° in relation to each other. The term "adjacent" means that the two groups 4 of cigarettes are arranged beside one another (as for example in the embodiment shown in FIGS. 3-5) or are arranged on top of one another (as for example in the embodiment shown in FIG. 6). In other words, the term "beside one another" means that the two groups 4 of cigarettes are arranged one beside the other and are adjacent to their respective side walls 8. While, when they are arranged on top of one another, the two groups 4 of cigarettes are adjacent at the respective lower walls 9 of the group 4 of cigarettes, the two groups 4 of cigarettes being rotated 180° in relation to each other. The group 4 of cigarettes is arranged in the inner containing element 2 that, at least partially, surrounds them. In particular, the groups 4 of cigarettes are completely surrounded by the inner containing element 2. The groups 4 of cigarettes are preferably sealed so as to preserve the aroma and freshness of the cigarettes.

The inner containing element 2 has two distinct and separate extraction openings 12 to access the respective groups 4 of cigarettes. When the groups 4 of cigarettes are arranged in the inner containing element 2, the openings 11 of the group 4 of cigarettes shall be arranged at the extraction opening 12 of the inner containing element 2, so that the group 4 of cigarettes can be accessed. The inner containing element 2 comprises a front wall 13, two side walls 14 arranged perpendicularly to the front wall 13, and/or a rear wall 15 (or at least a portion of a rear wall 15). The two extraction openings 12 are made on at least the front wall 13 of the inner containing element 2 through which it is possible to access the respective group 4 of cigarettes.

Figure 3:
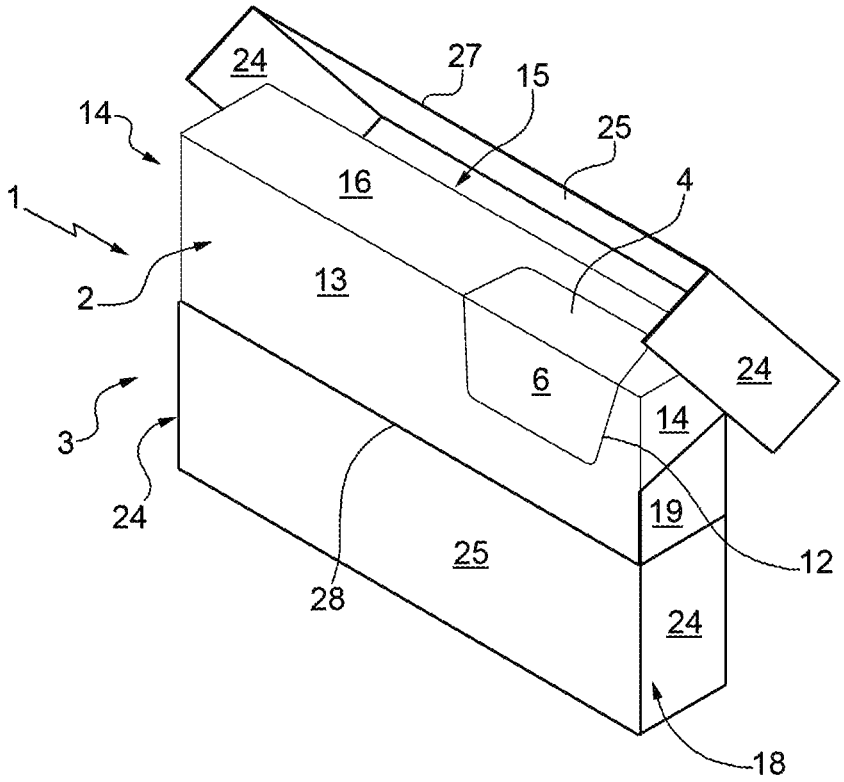
FIG. 3 is a front perspective view of the cigarette pack in FIG. 1 with one lid in the open position.
Figure 4:
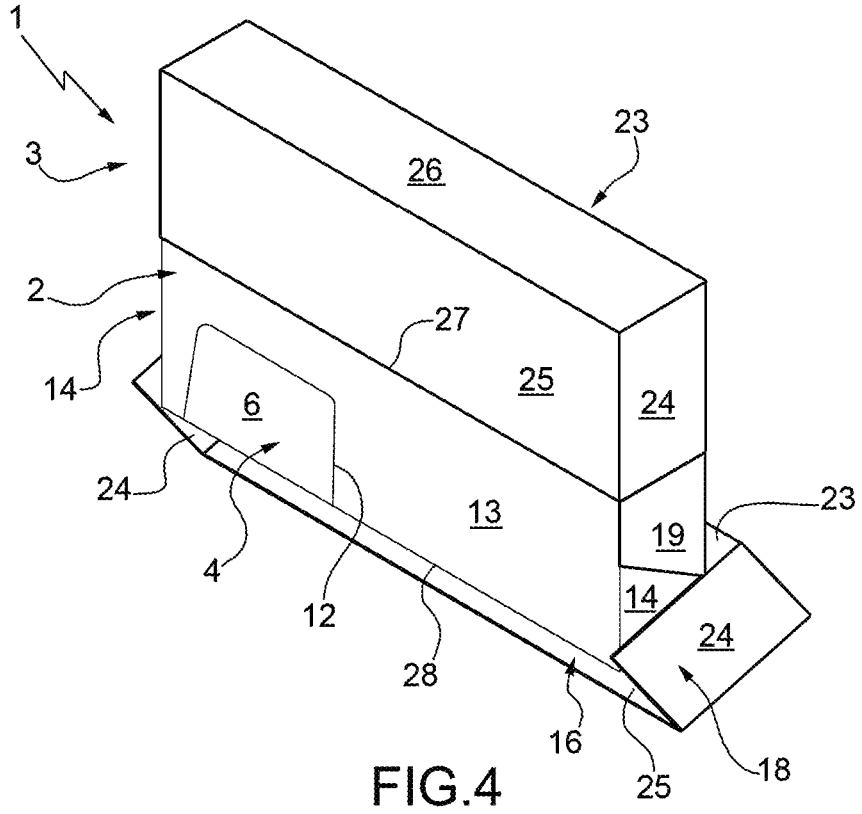
FIG. 4 is a front perspective view of the cigarette pack in FIG. 3 with the other lid in the open position.
Figure 5:
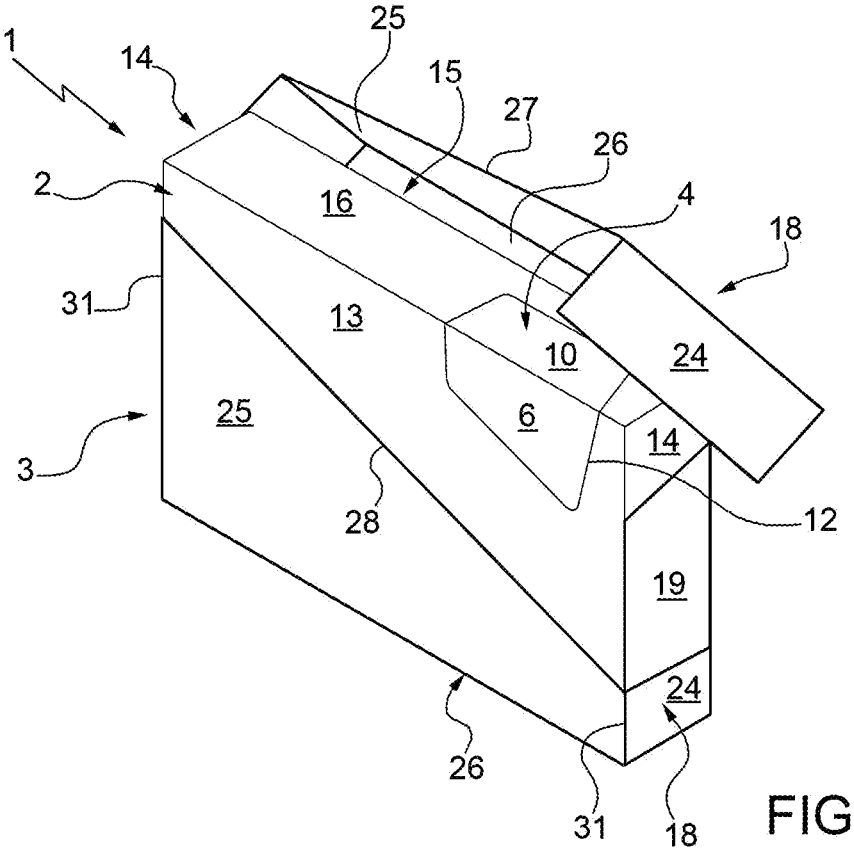
FIG. 5 is a front perspective view of a cigarette pack according to a second embodiment with one of the two lids in the open position.

According to a possible embodiment (shown, for example, in FIGS. 3-5), the inner containing element 2 also comprises two end walls 16 perpendicularly arranged to the front wall 13 and the respective rear wall 15. When the end walls 16 of the inner containing element 2 are present, each extraction opening 12 also extends partially at the respective end wall 16. That is, in this case, each extraction opening 12 extends at least partially at the front wall 13 and the end wall 16, as shown in FIGS. 3-5. In this embodiment, two rear walls 15 can be connected to the two end walls 16, the rear walls preferably being separated and spaced apart. Therefore, in this embodiment the two rear walls 15 of the inner containing element 2 are made like two panels that are arranged perpendicularly to the respective end wall 16. Alternatively, the rear wall 15 could also be single and connected to one of the two end walls 16.

The outer containing element 3 is arranged around the inner containing element 2, surrounding the two groups 4 of cigarettes arranged adjacent to each other. The outer containing element 3 comprises a rear wall 17 and two lids 18. The outer containing element 3 is devoid of (i.e. has no) front wall.

According to one possible embodiment, the outer containing element 3 may also comprise two side walls 19 that, if present, improve the housing of the inner containing element 2 in the outer containing element 3. In particular, the side walls 19 of the outer containing element 3 are arranged perpendicularly to the rear wall 17 of the outer containing element 3. Therefore, according to this embodiment, the outer containing element 3 comprises only the rear wall 17 and the two side walls 19. The two side walls 19 of the outer containing element 3 can be glued to the two side walls 14 of the inner containing element 2 preventing relative movement between the inner containing element 2 and the outer containing element 3.

Figure 2:
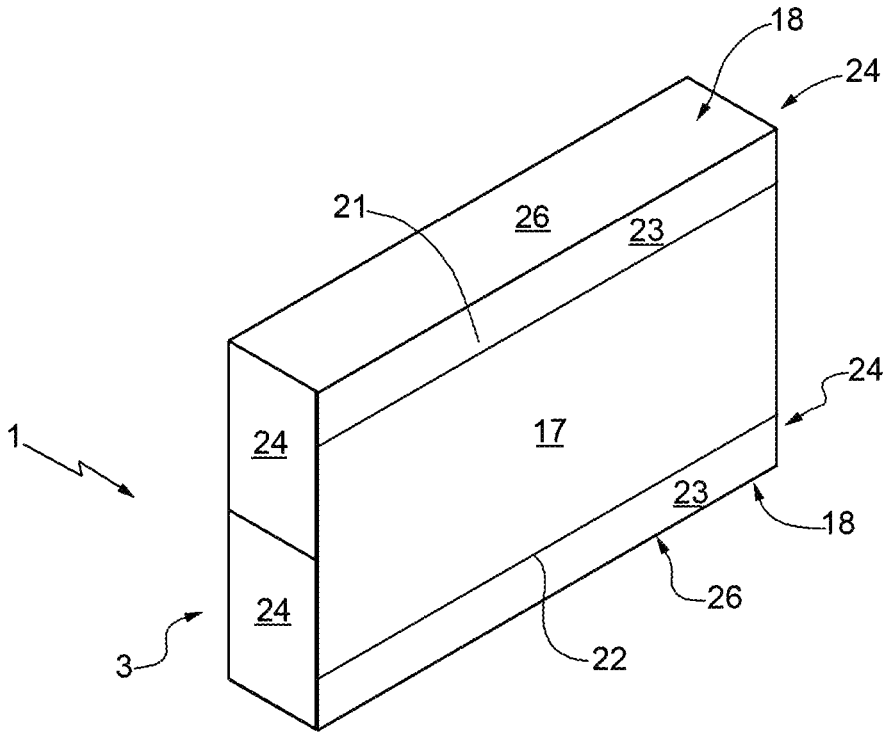
FIG. 2 is a rear perspective view of the cigarette pack in FIG. 1 with both lids in the closed position.

As shown in FIG. 2, the two lids 18 are hinged at opposite ends of the rear wall 17 of the outer containing element 3 along their respective hinges 21 and 22. In other words, one of the lids 18 is hinged to an edge 21 of the rear wall 17 (i.e. along the hinge 21) and the other lid 18 is hinged to the other edge 22 of the rear wall 17 (i.e. along the hinge 22). The lids 18 can be rotated between an open position and a closed position of the corresponding extraction openings 12 of the inner containing element 2. In the open position, the lid 18 allows access to the respective extraction opening 12, while in the closed position, the lid 18 closes the respective extraction opening 12. Each lid 18 has a substantially rectangular, parallelepiped shape and is cup-shaped. The lids 18 each comprise a rear wall 23 hinged to the rear wall 17 of the outer containing element 3, two side walls 24, a front wall 25, and an end wall 26 interposed between the front wall 25 and the rear wall 23.

As shown in FIG. 1, when both lids 18 are in the closed position, both cover substantially the whole front wall 13 of the inner containing element 2. In other words, in the closed position, a free edge 27 of the front wall 25 of the lid 18 is adjacent to a free edge 28 of the front wall 25 of the other lid 18, so that the front walls 25 of both lids 18 substantially cover the whole front wall 13 of the inner containing element 2. One half of the front wall 13 of the inner containing element 2 is covered by the lid 18, while the other half of the front wall 13 of the inner containing element 2 is covered by the other lid 18.

As shown in FIGS. 1-4 and 6, the two lids 18 may have their respective free edges 27 and 28 extending in a direction substantially perpendicular to the longitudinal extension of the cigarettes arranged in the group 4 of cigarettes. In other words, the two lids 18 have their respective free edges 27 and 28 extending in a direction parallel in relation to the end wall 26 of the respective lid 18. Therefore, the front wall 25 of each lid 18 has a rectangular shape.

As shown in FIG. 5, the two lids 18 may have their respective free edges 27 and 28 extending in a direction substantially transverse in relation to the longitudinal extension of the cigarettes arranged in the group 4 of cigarettes. In other words, the two lids 18 have their respective free edges 27 and 28 extending in an inclined direction in relation to the end wall 26 of the respective lid 18. Therefore, the front wall 25 of each lid 18 has a rectangular shape. In particular, the free edge 27 or 28 of each lid 18 forms an acute or obtuse angle with a side edge 31 of the front wall 25 (between, respectively, the front wall 25 and the side wall 24 of the same lid 18) of the lid 18 itself.

According to a first embodiment, the inner wrapping 5 can be made by folding and welding a heat-sealable sheet (FIG. 7). In this first embodiment, each inner wrapping 5 comprises an extraction opening 11 for the cigarettes and a possible repositionable closing tab (not shown in FIG. 7) that is mobile to open and close the opening 11. In accordance with a second embodiment, the inner wrapping 5 can be made by folding a blank made of a wrapping material (e.g. cardboard or a multilayer comprising a layer of paper). In this second embodiment, each inner wrapping 5 comprises an extraction opening 11 for the cigarettes and a repositionable closing tab, if necessary, that is mobile to open and close the opening 11.

Therefore, both if the inner wrapping 5 is made from a heat-sealable sheet and if the inner wrapping 5 is made from a blank in wrapping material, the cigarette pack 1 may comprise two closing tabs 50. Each closing tab can be connected to the inner containing element 2 above a corresponding extraction opening 12 and can be lifted to reveal the extraction opening 12 itself (FIG. 17) or can be connected to the inner wrapping 5 (embodiment not shown). The closing tab 50 is reusable (i.e. of the "open & close" type) and is connected to the inner containing element 2 or inner wrapping 5 by means of a repositionable glue. In addition, the closing tab 50 can be permanently connected (at a corresponding end flap 50*a*) to a respective lid 18 (advantageously, with the opening/closing of the lid 18, the closing label 50 is detached/reattached).

In addition, in accordance with an additional embodiment, the inner wrapping 5 could be made by folding a sheet of wrapping material (e.g. tin foil); this wrapping 5 comprises a portion that the smoker can manually detach, which creates an opening in the wrapping 5 for extracting the cigarettes. In this embodiment, the pack does not include any closing tab.

It is understood that one group 4 of cigarettes could have a wrapping 5 of a first type (for example, the wrapping 5 could be made from a sheet of heat-sealable material or a blank made of wrapping material or a sheet of tinfoil) and the other group 4 of cigarettes could have a wrapping 5 of a different type.

According to a possible embodiment, shown in FIGS. 1-5, each group 4 of cigarettes may have a width (i.e. the dimension measured in the direction perpendicular to the longitudinal extension of the cigarettes) equal to half the width of the inner containing element 2 and a height (i.e. the dimension measured in the direction of the longitudinal extension of the cigarettes) equal to the height of the inner containing element 2. In this case, the two groups 4 of cigarettes are arranged one beside the other and are adjacent to their respective side walls 8. As the two groups 4 of cigarettes are rotated 180°, the two extraction openings 12 are arranged at opposite vertices along a diagonal of the front wall 13 of the inner containing element 2. Each extraction opening 12 has a width around equal to a width of the inner containing element 2.

Figure 6:
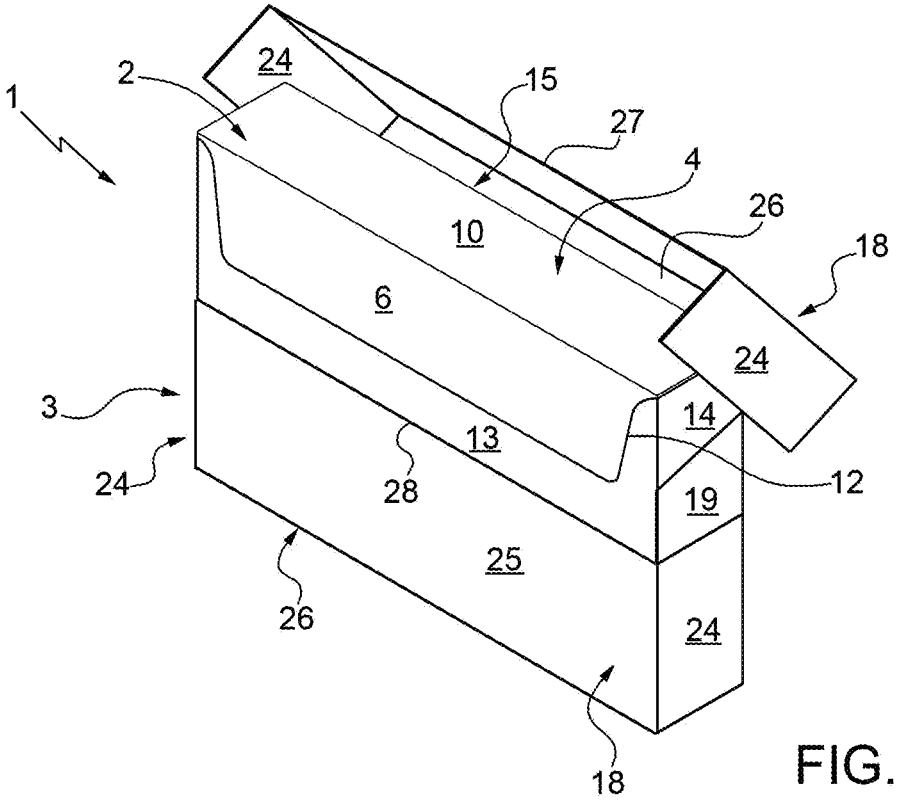
FIG. 6 is a front perspective view of a cigarette pack according to a third embodiment with one of the lids in the open position.

According to a possible alternative embodiment shown in FIG. 6, each group 4 of cigarettes has the width (i.e. the dimension measured in the direction perpendicular to the longitudinal extension of the cigarettes) equal to a width of the inner containing element 2 and the height (i.e. the dimension measured in the direction of the longitudinal extension of the cigarettes) equal to half of a height of the inner containing element 2. In this case, the two groups 4 of cigarettes are arranged on top of one another and are adjacent in the area of respective end walls 9 or 10. In particular, the two groups 4 of cigarettes are adjacent at the respective lower walls 9 of the group 4 of cigarettes. As can be seen in FIG. 6, the two extraction openings 12 have a width equal around equal to the width of the inner containing element 2. Therefore, according to this embodiment, the inner containing element 2 does not have the end wall 16.

The cigarette pack 1 shall preferably have writings or drawings at least on the front wall 13 of the inner containing element 2. In particular, the writings or drawings are arranged beside the extraction openings 12 or between the two extraction openings 12.

Figure 8:
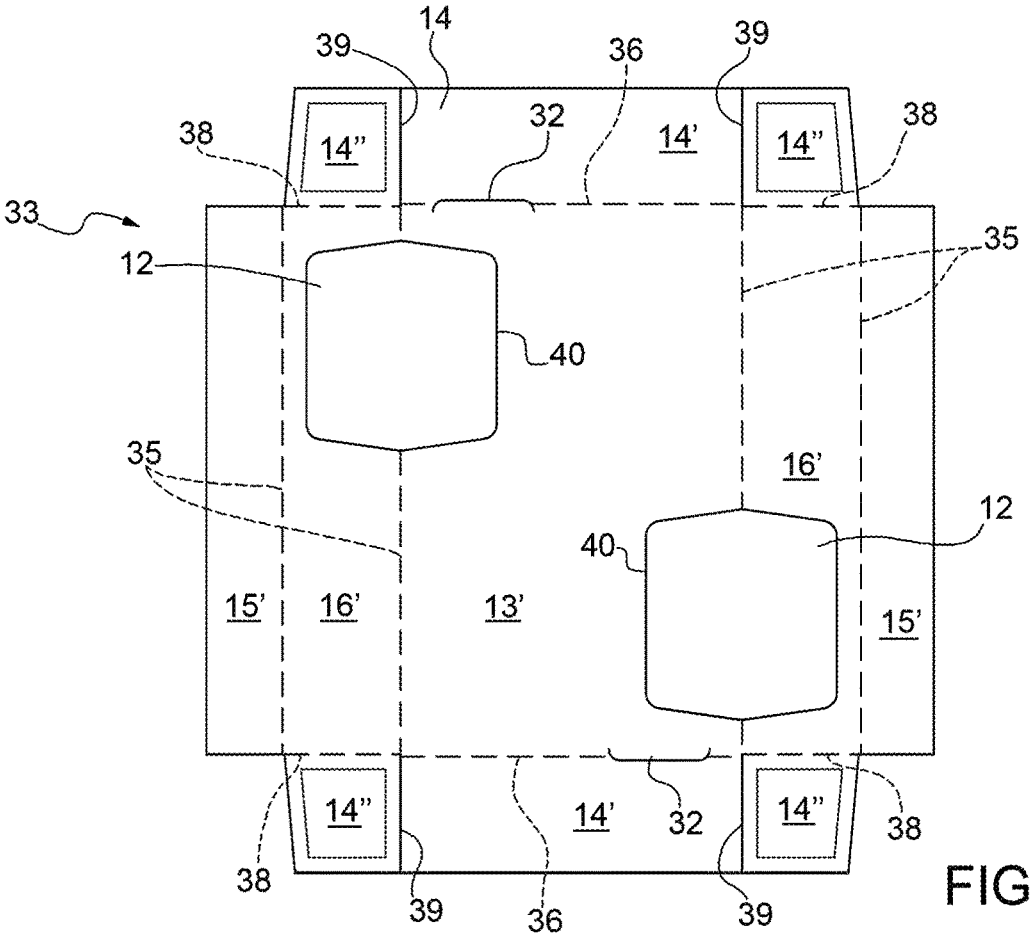
FIG. 8 is a plan view of a blank used to make an inner containing element of the pack according to the first embodiment shown in FIGS. 1-4.
Figure 10:
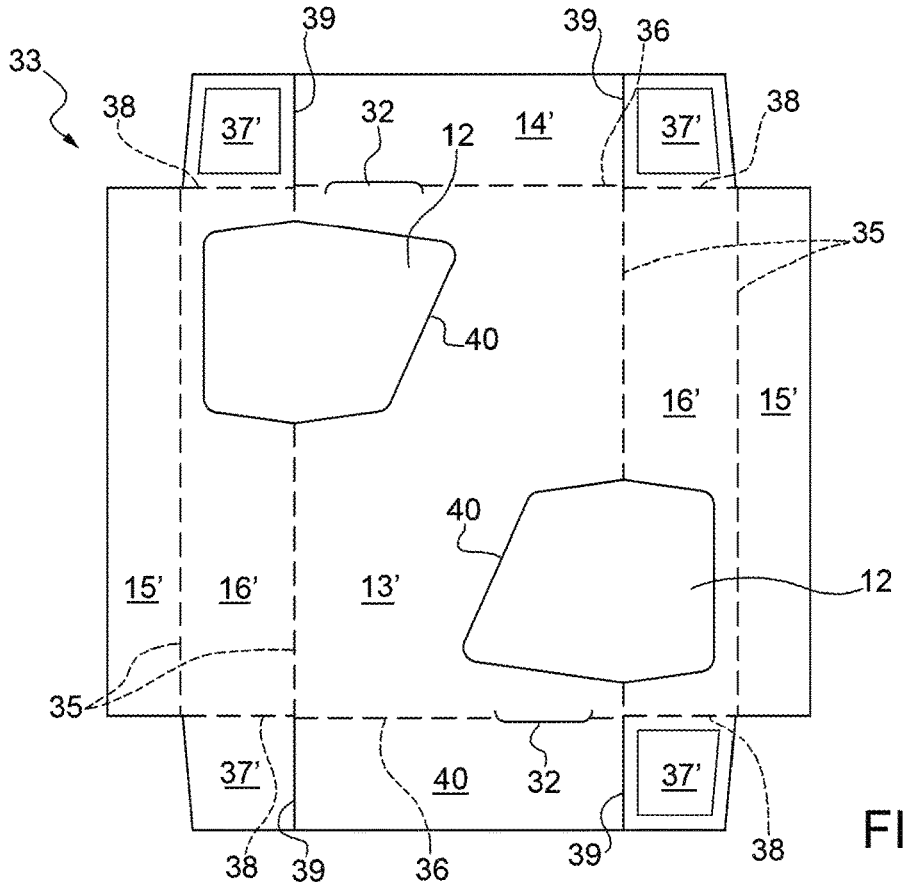
FIG. 10 is a plan view of the blank used to make the inner containing element of the pack according to the second embodiment shown in FIG. 5.
Figure 12:
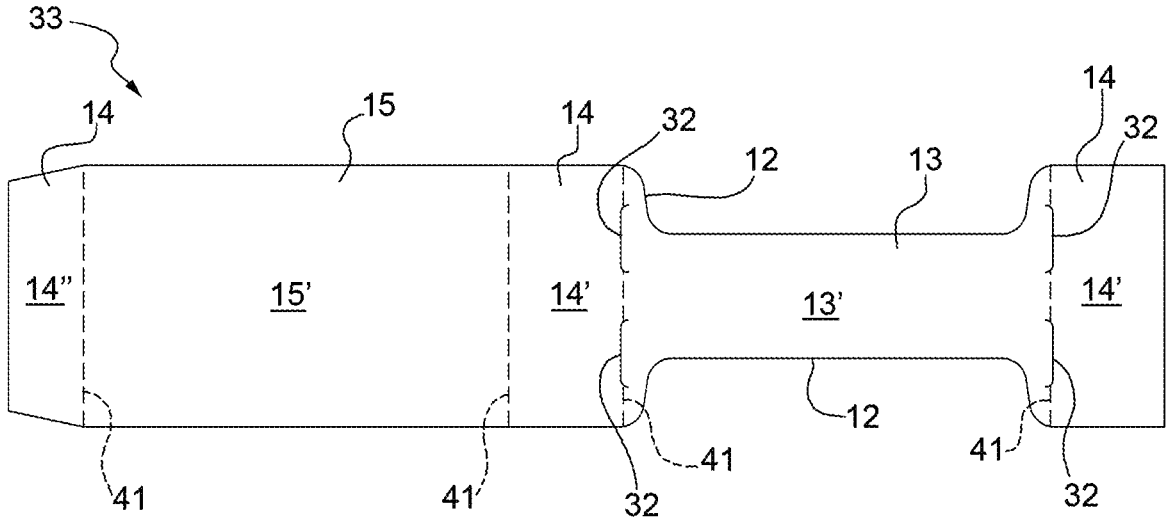
FIG. 12 is a plan view of the blank used to make the inner containing element of the pack according to the third embodiment shown in FIG. 6.

According to an additional embodiment, the inner containing element 2 can also be provided with at least one pair of claws 32 (shown in FIGS. 8, 10, and 12). The claws 32 protrude sideways from the inner containing element 2 to engage the side walls 24 of the respective lid 18 in order to keep the respective lid 18 in the closed position.

FIGS. 8-13 show the blanks 33 and 34 for making the inner containing element 2 and the outer containing element 3 respectively.

FIGS. 8 and 10 show possible blanks 33 for making the inner containing elements 2 of the packs shown in FIGS. 1-5. As shown in the figures, the blank 33 comprises, in succession, a panel 15' that constitutes the portion of the rear wall 15 of the inner containing element 2, a panel 16' that constitutes the end wall 16 of the containing element 2, a panel 13' that constitutes the front wall 13 of the inner containing element 2, an additional panel 16' that constitutes the other end wall 16 of the inner containing element 2, and an additional panel 15' that constitutes the additional portion of the rear wall 15 of the inner containing element 2. Each panel 15' is connected to the following and/or previous panel by means of a respective fold line 35 (in FIGS. 8 and 10 the fold lines 35 are shown substantially vertical, i.e. with transverse extension in relation to the extension of the group 4 of cigarettes housed within it). The blank 33 also comprises two panels 14' that constitute the side walls 14 of the inner containing element 2. The panels 14' are connected to the panel 13' at opposite edges by means of a fold line 36 that extends substantially orthogonal in relation to the fold lines 35. At the fold lines 36 delimiting the front wall 13, the claws 32, if present, are made. The blank 33 also, preferably, comprises four panels 14". The panels 14" extend, respectively, on both sides from the other panels 16". The panels 14" constitute fins to maintain the relative position between the panel 16" and the corresponding panel 14', i.e. between the respective end wall 16 and the respective side wall 14. The panels 14" are preferably provided with glue. The panels 14" are connected to the respective panel 16' at opposite edges by fold lines 38, substantially perpendicular in relation to the fold lines 35. The fold lines 36 and 38 are substantially aligned with each other. Each panel 14" is separated from the adjacent panel 14' by incision lines 39, in particular cutting lines. Two extraction openings 12 are made on the panel 13' and on the corresponding panel 16'. The two edges 40 of the extraction openings 12 that essentially face the centre of the panel 13' have an orientation (i.e. inclination) in relation to the fold line 36 in such a way that they are, in use, parallel to the respective free edge 27 and 28 of the respective lid 18. Therefore, the blank 33 in FIG. 8 differs from the blank 33 in FIG. 10 substantially in the inclination of the edge 40 of the extraction opening 12 in relation to the fold line 36 (i.e. the edge of the front wall 13 of the inner containing element 2). In FIG. 8, the edge 40 is substantially perpendicular to the fold line 36. On the other hand, in FIG. 10, the edge 40 is transverse, i.e. inclined, in relation to the fold line 36, forming an acute or obtuse angle with it.

In summary, the blank 33 shown in FIGS. 8 and 10 comprises two panels 15' panels that constitute two portions of the rear wall 15 of the inner containing element 2, two panels 16' that constitute the end walls 16 of the inner containing element 2 (each of which is adjacent to the panel 15') and the panel 13' that constitutes the front wall 13 of the inner containing element 2 (which is interposed between the two seventh panels 16'). The two extraction openings 12 are made on the two panels 16' and on the other panel 13'.

With reference to FIGS. 14-17, additional embodiments of the blanks 33 are shown in order to make inner containing elements 2.

Figure 14:
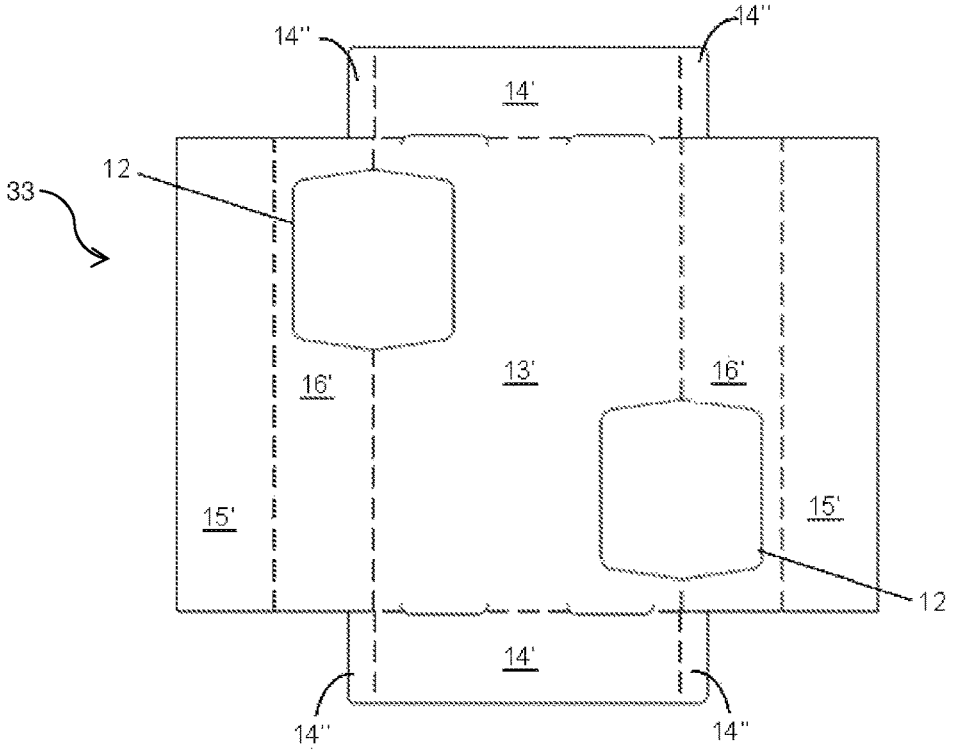
FIGS. 14-16 are plan views of the respective embodiments of the blank used to make the inner containing element of the pack; these are alternatives to the blanks in FIGS. 8 and 10.

The blank 33 in FIG. 14 differs from the blank 33 in FIG. 8 only in that the panels 14" that are connected to the respective panel 14' at opposite edges by fold lines and are separated from the respective panel 16' by incision lines.

Figure 15:
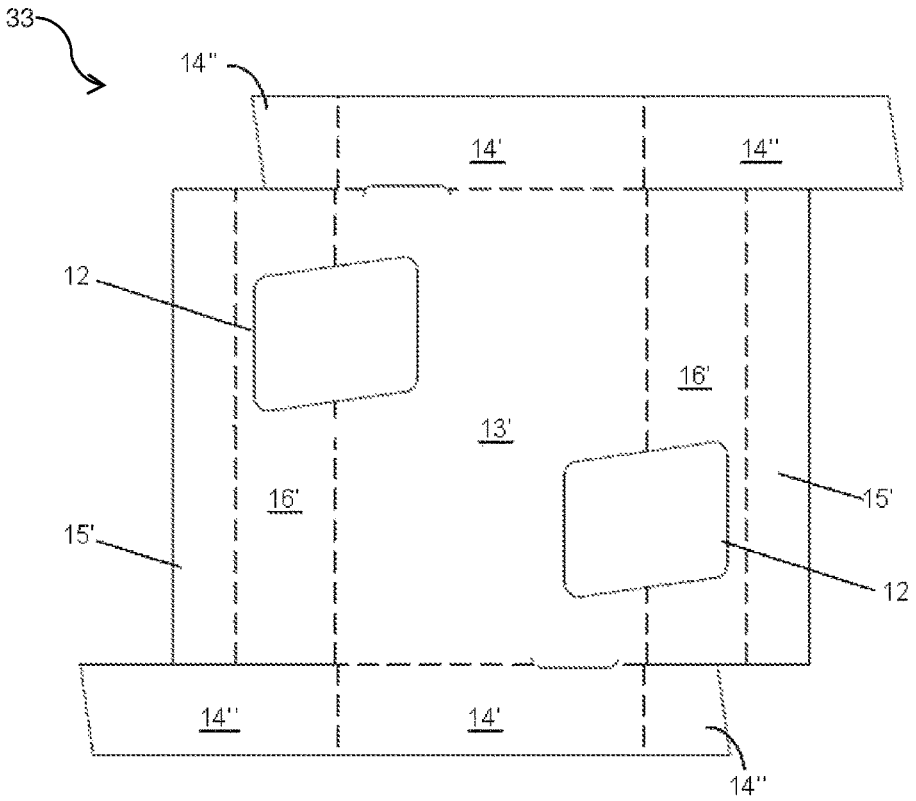

The blank 33 in FIG. 15 differs from the blank 33 in FIG. 14 in the sizing of the panels 14": the panels 14" of the blank 33 in FIG. 15 have different sizes between the panel pairs. In this embodiment, the blank 33 can advantageously be made from a strip of material without scrap material. In addition, the blank 33 in FIG. 15 differs from the blank 33 in FIG. 14 in the shape of the opening 12.

Figure 17:
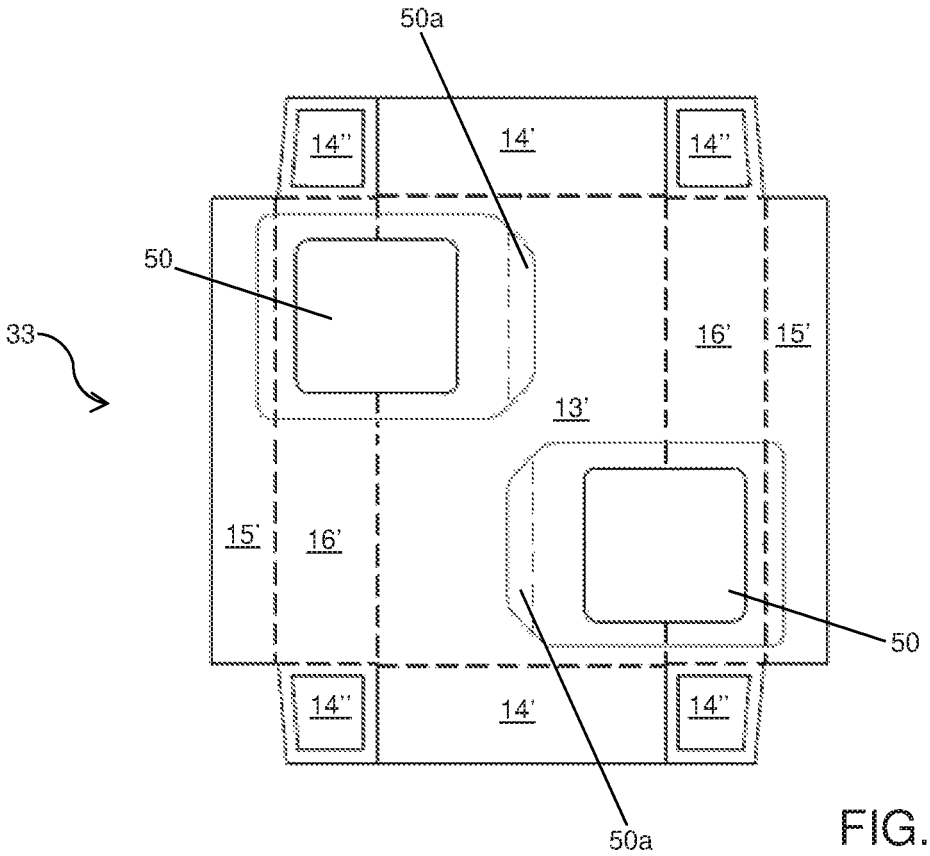
FIG. 17 is a plan view of an additional embodiment of the blank for making the inner containing element, similar to that in FIG. 8, wherein the closing tabs are applied.

The blank 33 in FIG. 17 differs from the blank 33 in FIG. 8 in the shape of the opening 12 and in the presence of the two closing tabs 50.

With reference to the blanks 33 in FIGS. 8, 10, 14, and 15, if the pack comprises two closing tabs, they will preferably be fixed by repositionable glue to the inner containing element 2 (in a manner similar to that shown in FIG. 17).

Figure 16:
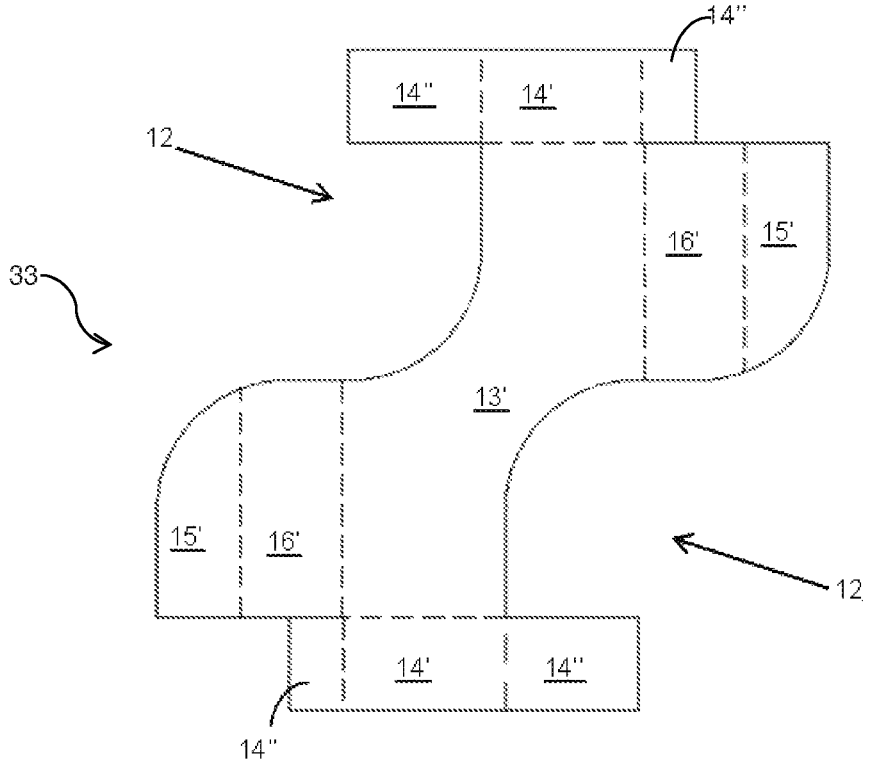

The blank 33 in FIG. 16 differs from the blank 33 in FIG. 15 in the shape of the opening 12 and in the sizing of the panels 15', intended to form the rear wall, and of the panels 16' intended to form the end wall 16. This embodiment of the blank 33 can also, advantageously, be made from a strip of material without scrap material.

Moreover, since the opening 12 is larger than the other embodiments, this blank 33 is particularly suitable for making a pack wherein the two possible closing tabs 50 are fixed to the inner wrapping 5 and not to the inner containing element 2.

FIG. 12 shows the blank 33 for making the inner containing element 2 of the cigarette pack 1 according to the embodiment shown in FIG. 6. According to this embodiment, the blank 33 comprises a panel 14" that constitutes a part of the side wall 14 of the inner containing element 2, a panel 15' that constitutes the back wall 15 of the inner containing element 2, an additional panel 14' that constitutes the other side wall 14 of the inner containing element 2, a panel 13' that constitutes the front wall 13 of the inner containing element 2, and a panel 14' that constitutes the other portion of the side wall 14. In particular, this last panel 14' overlaps and is glued to the panel 14". Each panel 14",14', and 13' of the blank 33 is connected to the following and/or previous panel by a respective fold line 41. At the fold lines 41 delimiting the front wall 13 of the inner containing element 2, the claws 32, if present, are made.

In summary, the blank 33 shown in FIG. 12 comprises the panel 14" that constitutes the part of the side wall 14 of the inner containing element 2, the panel 15' that constitutes the rear wall 15 of the inner containing element 2 (that is arranged beside the panel 14"), the panel 13' that constitutes the front wall 13 of the inner containing element 2, and two panels 14' that constitute, respectively, the two side walls 14 of the inner containing element 2. The panel 14' is interposed between the second panel 15' and the third panel 13', while the first panel 14' is arranged beside the third panel 13'.

Figure 9:
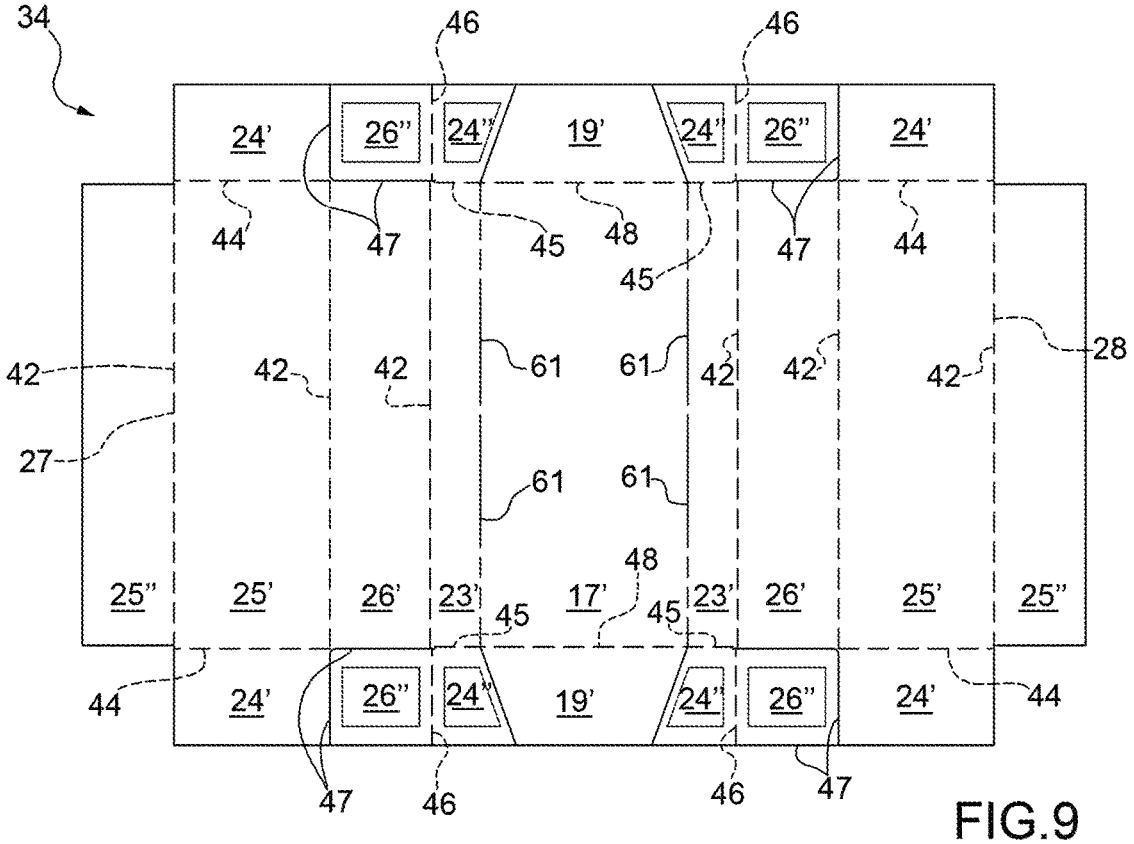
FIG. 9 is a plan view of a blank used to make an outer containing element of the pack according to the first embodiment shown in FIGS. 1-4.
Figure 11:
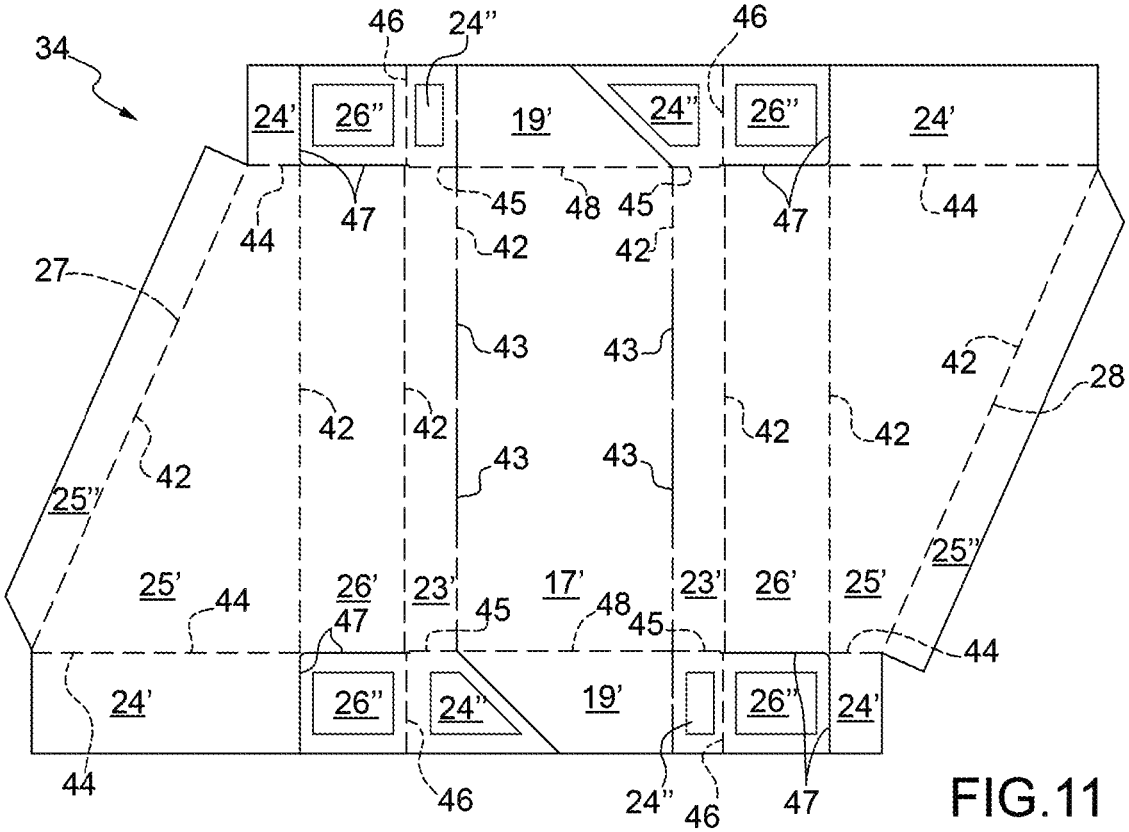
FIG. 11 is a plan view of the blank used to make the outer containing element of the pack according to the second embodiment shown in FIG. 5.
Figure 13:
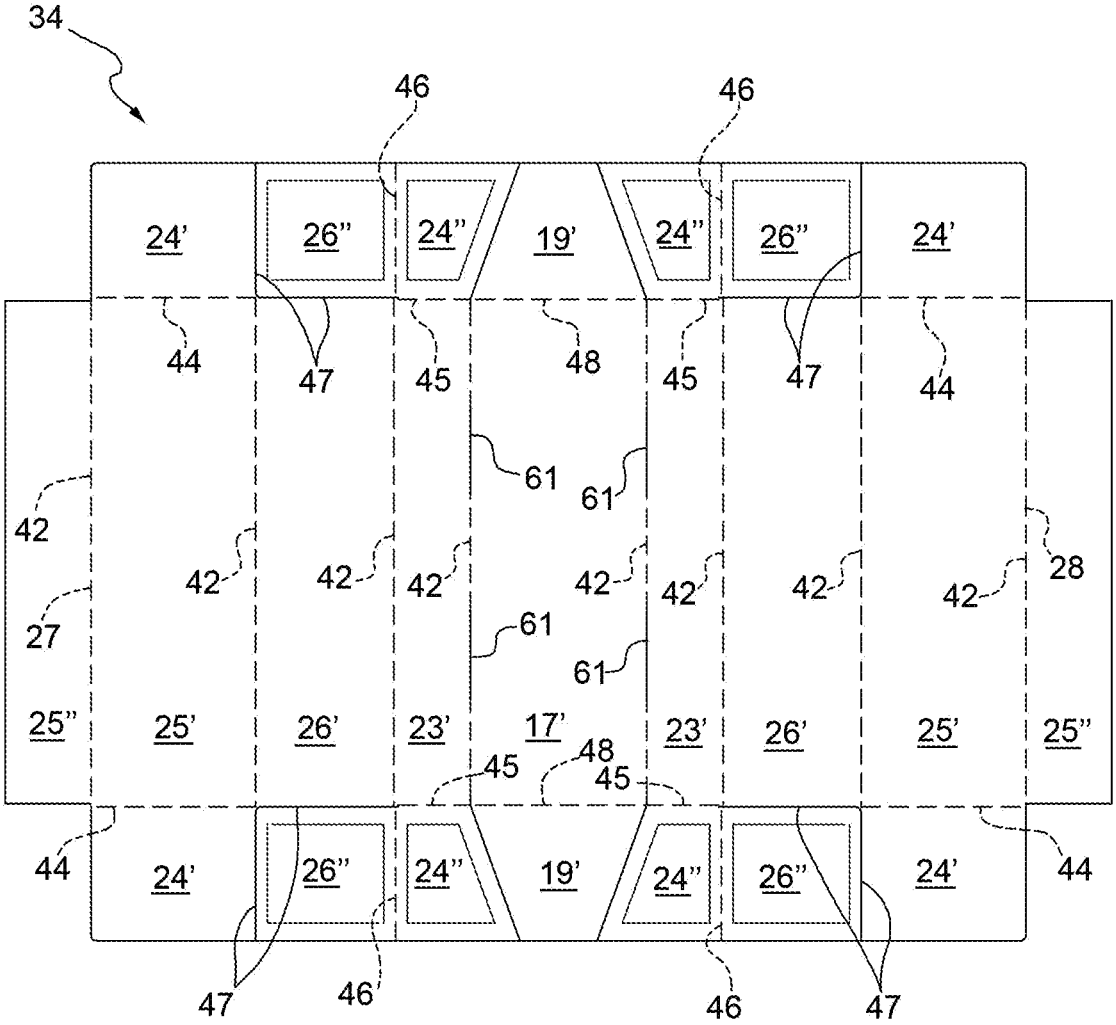
FIG. 13 is a plan view of the blank used to make the outer containing element of the pack according to the third embodiment shown in FIG. 6.

FIGS. 9, 11, and 13 show the blank 34 of the outer containing element 3.

The blank 34 of the outer containing element 3 comprises, in succession, a panel 25" that constitutes a reinforcement flap of the front wall 25 of the lid 18, a panel 25' that constitutes the front wall 25 of the lid 18, a panel 26' that constitutes the end wall 26 of the lid 18, a panel 23' that constitutes the rear wall 23 of the lid 18, a panel 17' that constitutes the rear wall 17 of the outer containing element 3, an additional panel 23' that constitutes the rear wall 23 of the other lid 18, an additional panel 26' that constitutes the end wall 26 of the other lid 18, an additional panel 25' that constitutes the front wall 25 of the other lid 18, and a panel 25" that constitutes the reinforcement flap of the front wall 25 of the other lid 18.

Each panel of the blank 34 is connected to the following and/or previous panel by a respective fold line 42. In FIGS. 9 and 13, the fold lines 42 are shown substantially vertical, i.e. with transverse extension in relation to the extension of the group 4 of cigarettes housed within it.

The reinforcement flap 25" of the two lids 18 are configured to be overlapped (i.e. folded 180° along the respective fold line 42) and glued to the panel 25' to construct a reinforcement inside the respective front wall 25 of each lid 18.

The blank 34 in FIG. 9 or 13 differs from the blank 34 in FIG. 11 substantially in terms of the inclination of the fold line 42 interposed between the panels 25' and 25" in relation to the other fold lines 42. In particular, the two fold lines 42 are inclined in relation to the side edge 31 of the front wall 25 of the lid 18. The two inclined fold lines 42 make, respectively, the free edge 27 or 28 of the lid 18 when the two reinforcement flaps 25" are folded in relation to the panel 25'. At the two fold lines 42 delimiting the front wall 17 there may be portions having incision lines 43, in particular cutting lines (optional).

As shown in FIGS. 9, 11, and 13, at opposite edges of the panel 25', two panels 24' respectively extend that constitute the side wall 24 of the lid 18. The panel 25' is connected to the other panel 24' by a fold line 44. The fold line 44 substantially makes the side edge 31 of the front wall 25 of the lid 18.

The panels 24" extend from opposite edges of the two panels 23', the former constituting, together with the panels 26", fins to maintain the relative position between the panels 23',25' and 26', i.e. between the respective rear walls 23, the front walls 25, and the end walls 26 of each lid 18. The panels 24" extend at opposite edges of the panel 23' and are connected to it by fold lines 45 that are substantially perpendicular to the other fold lines 42. In contrast, the panels 24" and 26" are connected to each other by fold lines 46 that are substantially aligned with the respective fold line 42 arranged between the panels 26' and 23'. The panels 24' and 26' are respectively overlapped and glued to the panels 24" and 26" of the respective lid 18.

The panels 26" are separated by the respective adjacent panels 26' and 24' by incision lines 47, in particular cutting lines. The incision lines 47 comprise two incision lines arranged perpendicular to each other. An incision line is arranged between the panels 26' and 26" and the other between the panels 24' and 26". The panels 19' extend respectively from two opposite edges of the panels 17', the former constituting the side walls 19 of the outer containing element 3. The panels 19' are connected to the respective panel 17' by a fold line 48. The fold line 48 is substantially aligned with the other fold line 44. In summary, the blank 34 comprises two panels 25" that constitute the reinforcement flap of the respective lid 18, two panels 25' that constitute the front wall 25 of the respective lid 18 (each of which is adjacent to the panel 25"), two panels 26' that constitute the end wall 26 of the respective lid 18 (each of which is adjacent to the second panel 25'), two panels 23' constituting the rear wall 23 of the respective lid 18 (each of which is adjacent to the third panel 26') and the panel 17' constituting the rear wall 17 of the outer containing element 3 (that is interposed between the two fourth panels 23').

The cigarette pack 1 described above has multiple advantages.

Mainly, the cigarette pack 1 has a greater surface area available for applying promotional messages and images compared to known packs. In fact, in known packs it is only possible to apply promotional messages and/or images on the surface of the collar projecting from the cup body and visible when the lid is opened 18. In contrast, with the cigarette pack 1 in question, promotional messages and images can be applied to the whole front wall 13 of the inner containing element 2. In this way, the surface area available for applying promotional messages and images is considerably increased, while maintaining the consumption of material for producing the blank 33 and 34 almost unchanged and making maximum use of the space available for the assembly of groups 4 of cigarettes.

It is understood that the cigarettes of one group 4 may be arranged in an opposite orientation to the cigarettes of the other group 4. In this case, the smoker will extract the cigarettes of one group 4 from, for example, the tobacco side, and the cigarettes of the other group 4 from, for example, the filter side.

The cigarette pack 1 also has the advantage that the lids 18 and, thus, the respective extraction openings 12 can be opened one at a time (i.e. not simultaneously), thus better preserving the freshness of the group 4 of cigarettes that is not opened. In other words, by opening one of the lids 18 it is possible to access only and exclusively a given group 4 of cigarettes, while the other group 4 of cigarettes is kept closed. It is, therefore, possible to access groups 4 of cigarettes independently of each other. The group 4 of cigarettes that is not opened and will be consumed later, thus preserves its freshness and aroma. This is even more important in packs wherein the closing tab is permanently connected to the lid 18.

Should the smoker still want to open both lids, the pack 1 described so far allows for greater stability by being arranged essentially horizontally, supported by the front walls 25 of each lid 18. In particular, the embodiment shown in FIG. 6 has the advantage that by opening both the lids 18, the pack 1 of cigarettes could be used as a box, case, or table-top display. In fact, by opening the two lids 18 at the same time, they can be used as support points to keep the pack open and accessible for the removal of cigarettes.

Another advantage of the pack 1 described so far is that the amount of material used to make the blanks 33 and 34 is similar to that of the known rigid packs.

In addition, the cigarette pack 1, which is the subject of the invention, is simple and economical to produce.

The invention claimed is:

1. A pack (1) for smoking articles comprising:

two groups (4) of smoking articles arranged adjacent to one another;

an inner containing element (2), which surrounds the two groups (4) of smoking articles, has two distinct and separate extraction openings (12) to access the respective groups (4) of smoking articles, and comprises a front wall (13), two side walls (14) and optionally a rear wall (15);

an outer containing element (3), which is arranged around the inner containing element (2), surrounds the two groups (4) of smoking articles, and comprises a rear wall (17); the outer containing element (3) has no front wall; and two lids (18), which are hinged at opposite ends of the rear wall (17) of the outer containing element (3), rotate between an open position and a closed position of the corresponding extraction openings (12), and each comprise a rear wall (23) hinged to the rear wall (17) of the outer containing element (3), two side walls (24), a front wall (25) and an end wall (26) interposed between the front wall (25) and the rear wall (23);

the pack (1) for smoking articles is characterized in that:

each group (4) of smoking articles has a width equal to half a width of the inner containing element (2) and a height equal to a height of the inner containing element (2);

the two groups (4) of smoking articles are arranged beside one another and are adjacent in the area of respective side walls (8); and the two extraction openings (12) are arranged in the area of opposite vertexes along a diagonal of the front wall (13) of the inner containing element (2) and each have a width that is approximately equal to half a width of the inner containing element (2).

2. The pack (1) for smoking articles according to claim 1, wherein, in the closed position, an edge (27) of the front wall (25) of a lid (18) is adjacent to an edge (28) of the front wall (25) of the other lid (18), so that both front walls of both lids (18) cover the entire front wall (13) of the inner containing element (2).

3. The pack (1) for smoking articles according to claim 1, wherein the outer containing element (3) comprises the rear wall (17) and two side walls (19) arranged perpendicular to the rear wall (17).

4. The pack (1) for smoking articles according to claim 3, wherein the two side walls (19) of the outer containing element (3) are glued to the two side walls (14) of the inner containing element (2).

5. The pack (1) for smoking articles according to claim 1, wherein the inner containing element (2) comprises the front wall (13), the two side walls (14) arranged perpendicularly to the front wall (13), two end walls (16) and two rear walls (15), which are separate and spaced apart from one another, and wherein the extraction openings (12) at least partially extend in the corresponding end walls (16) and in the front wall (13).

6. The pack (1) for smoking articles according to claim 1 and comprising two closing tabs, each connected to the inner containing element (2) on a corresponding extraction opening (12) and capable of being lifted in order to uncover the extraction opening (12) itself.

7. The pack (1) for smoking articles according to claim 6, wherein at least one closing tab is connected to a respective lid (18) in a permanent manner.

8. The pack (1) for smoking articles according to claim 1, wherein:

the front wall (25) of each lid (18) has a trapezoidal shape; and a free edge (27, 28) of each lid (18) forms an acute or obtuse angle with a side edge (31) of the front wall (25) of the lid (18).

9. The pack (1) for smoking articles according to claim 1, wherein the front wall (13) of the inner containing element (2) is provided with writings or drawings arranged beside the extraction openings (12) or between the extraction openings (12).

10. The pack (1) for smoking articles according to claim 1:

wherein in the area of the front wall (13) of the inner containing element (2) there are, at least partially, the first extraction opening (12) to access the first group (4) of smoking articles and the second extraction opening (12) to access the second group (4) of smoking articles;

the first lid (18), which is hinged to a first edge (21) of the rear wall (17), and the second lid (18), which is hinged to a second edge (22) of the rear wall (17); wherein each first and second lid (18) is provided with the front wall (25), the end wall (26) and the rear wall (23) and is configured to be arranged, in use, between the closed position, in which it closes the respective extraction opening (12), and the open position, in which it allows access to the respective extraction opening (12); and in the closed position, both lids (18) cover the entire front wall (13) of the inner containing element (2).

11. A blank (33) for forming the inner containing element (2) of the pack (1) for smoking articles according to claim 1; the blank (33) comprises:

two first panels (15'), which constitute two portions of the rear wall (15) of the inner containing element (2);

two second panels (16'), which constitute the end walls (16) of the inner containing element (2) and are each adjacent to the first panel (15');

an third panel (13'), which constitutes the front wall (13) of the inner containing element (2) and is interposed between the two second panels (16');

the two extraction openings (12) are made in the area of the second panels (16') and of the third panel (13') and wherein the two extraction openings (12) are arranged in the area of opposite vertexes along a diagonal of the third panel (13') and each have a width that is approximately equal to half a width of the third panel (13').

* * * * *